US007624767B2

(12) United States Patent
Enqvist et al.

(10) Patent No.: US 7,624,767 B2
(45) Date of Patent: Dec. 1, 2009

(54) DRYER FABRIC AND DRYER FABRIC SEAM AREA

(75) Inventors: Rauno Enqvist, Nokia (FI); Aira Liitola, Lempäälä (FI)

(73) Assignee: Tamfelt PMC Oy, Tampere (FI)

( * ) Notice: Subject to any disclaimer, the term of this patent is extended or adjusted under 35 U.S.C. 154(b) by 93 days.

(21) Appl. No.: 12/073,780

(22) Filed: Mar. 10, 2008

(65) Prior Publication Data

US 2008/0230139 A1 Sep. 25, 2008

(30) Foreign Application Priority Data

Mar. 20, 2007 (FI) ..... 20070118 U

(51) Int. Cl.

| | |
|---|---|
| ***D03D 3/02*** | (2006.01) |
| ***D21F 1/12*** | (2006.01) |
| ***D21F 7/10*** | (2006.01) |
| *D03D 25/00* | (2006.01) |

(52) U.S. Cl. ..... 139/383 AA; 139/383 A; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | | |
|---|---|---|---|---|---|
| 4,186,780 | A | * | 2/1980 | Josef et al. | 139/383 AA |
| 4,364,421 | A | * | 12/1982 | Martin | 139/383 AA |
| 4,476,902 | A | * | 10/1984 | Westhead | 139/383 AA |
| 4,574,435 | A | * | 3/1986 | Luciano et al. | 24/33 C |
| 4,601,785 | A | * | 7/1986 | Lilja et al. | 162/199 |
| 4,676,369 | A | * | 6/1987 | Borel | 198/853 |
| 4,695,015 | A | * | 9/1987 | Salminen | 245/6 |
| 4,902,383 | A | * | 2/1990 | Penven | 162/199 |
| 4,958,673 | A | * | 9/1990 | Dufour | 162/358.2 |
| 4,985,084 | A | * | 1/1991 | Hakkarainen et al. | 139/383 A |
| 5,053,109 | A | * | 10/1991 | Penven | 162/348 |
| 5,082,532 | A | * | 1/1992 | Dufour | 162/358.2 |
| 5,188,884 | A | * | 2/1993 | Smith | 428/193 |
| 5,346,590 | A | * | 9/1994 | Jaala | 162/232 |
| 5,377,722 | A | * | 1/1995 | Jaala | 139/383 AA |
| 5,458,161 | A | * | 10/1995 | Scarfe | 139/383 AA |
| 5,601,877 | A | * | 2/1997 | Miller et al. | 427/373 |
| 5,904,187 | A | * | 5/1999 | Davenport | 139/383 AA |
| 5,916,421 | A | * | 6/1999 | Yook | 162/358.2 |
| 6,001,443 | A | * | 12/1999 | Holden et al. | 428/61 |
| 6,194,331 | B1 | * | 2/2001 | Elkins | 442/225 |

(Continued)

*Primary Examiner*—Bobby H Muromoto, Jr.
(74) *Attorney, Agent, or Firm*—Oliff & Berridge, PLC

(57) ABSTRACT

A dryer fabric and a seam area of a dryer fabric. The basic structure of the dryer fabric having at least two superposed machine direction yarn systems. Some yarns of a paper side machine direction yarn system form seam loops at connecting ends and some of the paper side machine direction yarns form an edge of the seam area. All the machine direction yarns of the paper side system make a backward turn at the connecting end and they are fastened off on the backside. The paper side machine direction yarns are cut at a cutting point. Cutting points form a fasten-off row. Yarns that form seam loops are fastened off in a first fasten-off row and yarns that form an edge of the seam area are fastened off in one or more second fasten-off row. One fasten-off row is situated at the beginning line of the seam area.

14 Claims, 2 Drawing Sheets

U.S. PATENT DOCUMENTS 6,378,566 B1 * 4/2002 Kornett ..... 139/383 AA
6,451,412 B1 * 9/2002 Holden ..... 428/193
6,508,278 B1 * 1/2003 Kornett ..... 139/383 A
6,712,100 B2 * 3/2004 Yook et al. ..... 139/383 A
6,719,014 B2 * 4/2004 Kornett ..... 139/383 R
6,918,998 B2 * 7/2005 Hansen ..... 162/358.2
7,032,625 B2 * 4/2006 Rydin ..... 139/383 A
7,381,307 B2 * 6/2008 Silakoski ..... 162/358.2
2002/0115368 A1 * 8/2002 Yook et al. ..... 442/224
2002/0139503 A1 * 10/2002 Davenport ..... 162/358.1
2004/0020622 A1 * 2/2004 Hyvonen et al. ..... 162/358.1
2004/0261883 A1 * 12/2004 Harrison ..... 139/383 A
2004/0261884 A1 * 12/2004 Rydin ..... 139/383 A
2008/0230139 A1 * 9/2008 Enqvist et al. ..... 139/383 AA

* cited by examiner

MD
1
S
12
11
17
15
13
16
P
19
16
K2

T
L
d
6
5b
c
20
5a
K1
10
b
18
5a
6
a
9
5a
R2
9
R1
10
19
13

DRYER FABRIC AND DRYER FABRIC SEAM AREA

BACKGROUND OF THE INVENTION

The invention relates to a dryer fabric, which has a bottom surface and a surface facing a paper web to be dried and which is woven of a plurality of machine direction longitudinal yarns and a plurality of cross machine direction transverse yarns; and in which dryer fabric there are at least two superposed machine direction yarn systems, namely, the paper side machine direction yarns and the backside machine direction yarns; and in which dryer fabric there is at least one first cross machine direction connecting end and at least one second cross machine direction connecting end, each of the connecting ends comprising a seam area and on the outermost edge of the connecting end a plurality of seam loops for interconnecting the connecting ends of the dryer fabric and for providing a dryer fabric in the form of a closed loop; and which seam area has a predetermined length in machine direction extending from the seam loops to a cross machine direction line where the basic structure of the dryer fabric begins; and in which a plurality of paper side first machine direction yarns are arranged to form said seam loops and in which a plurality of paper side second machine direction yarns are arranged to form the outermost edge of the seam area; and in which the paper side machine direction yarns are cut and fastened off by weaving in the seam area on the backside of the dryer fabric such that in the seam area there is at least one cross machine direction fasten-off row; and further, in which the machine direction yarns of the backside extend to said fasten-off row.

The invention also relates to a dryer fabric seam area locating at a connecting end of the dryer fabric, the dryer fabric comprising: a bottom surface and a surface facing a paper web to be dried; a plurality of cross machine direction transverse yarns and a plurality of machine direction longitudinal yarns arranged to form at least two superposed machine direction yarn systems, namely a paper side machine direction yarn system and a backside machine direction yarn system; the outermost first edge of the seam area comprising a plurality of seam loops; the seam area having a predetermined length in machine direction extending from the first edge to the second edge on the side of the basic structure of the dryer fabric; in which seam area a plurality of first paper side machine direction yarns are arranged to form said seam loops and in which a plurality of the second paper side machine direction yarns are yarns are arranged to form the outermost edge of the seam area; and in which the paper side machine direction yarns are cut and fastened off by weaving in the seam area on the backside of the dryer fabric such that in the seam area there is at least one cross machine direction fasten-off row and further, in which the backside machine direction yarns extend to said fasten-off row.

The dryer section of a paper machine employs dryer fabrics, by means of which the paper web to be dried is applied through the dryer section. The dryer fabric is made of yarns resisting to high temperatures and humidity by using appropriate weaves for the dryer fabric to have a given permeability. The dryer fabric is run on the paper machine as an endless loop. The dryer fabric may be manufactured endless or it may be provided with a seam. For the seam, at both ends of the dryer fabric there may be provided seam loops that may be interlaced on mounting to form a seam loop passage in which a seam yarn or a corresponding member may be arranged for interconnecting the fabric ends. A problem with the conventional dryer fabrics is that it is cumbersome and time consuming to provide seam areas at the dryer fabric ends on the seaming machine.

BRIEF DESCRIPTION OF THE INVENTION

The object of the invention is to provide a novel and improved dryer fabric with seam, and a seam area of the dryer fabric.

The dryer fabric of the invention is characterized in that the seam area comprises at least two cross machine direction fasten-off rows at a machine direction distance from one another; that the machine direction yarns that form seam loops have been fastened off in a first fasten-off row and the machine direction yarns that form an edge of the seam area have been fastened off in at least one second fasten-off row; and that one fasten-off row is substantially at the beginning line of the seam area.

The seam area of the dryer fabric in accordance with the invention is characterized in that the seam area comprises at least two cross machine direction fasten-off lines at a machine direction distance from one another; that the machine direction yarns that form seam loops have been fastened off in a first fasten-off row and the machine direction yarns that form an edge of the seam area have been fastened off in at least one second fasten-off row; and that one fasten-off row is substantially at the second edge of the seam area.

The basic idea of the invention is that the basic structure of the dryer fabric comprises at least two superposed machine direction yarn systems, namely a machine direction yarn system of the paper side and a machine direction yarn system of the backside. Some of the paper side machine direction yarns form seam loops at connecting ends of the dryer fabric and some of the paper side machine direction yarns form an edge of the seam area at the connecting end. All the machine direction yarns of the paper side system thus make a backward turn at the connecting end and they are fastened off on the backside of the fabric on a separate seaming machine. The paper side machine direction yarns are woven using a suitable weave on the seam area and they are cut. At the cutting point there is provided a fasten-off point and a plurality of fasten-off points provided in alignment form a cross machine direction fasten-off row. There are at lest two fasten-off rows, because the yarns forming seam loops are fastened off in the first fasten-off row. The yarns forming the edge of the seam area are fastened off in one or more second fasten-off rows locating at a distance from the first fasten-off row. The fasten-off rows are thus locating at different points seen in the machine direction. Further, one of said fasten-off rows is placed substantially on the borderline between the seam area and the basic fabric. The machine direction yarns of the backside system are woven up to the fasten-off rows.

The invention has an advantage that fasten-off rows need not be separately reinforced by means of silicon or the like, because the fasten-off row of the yarns forming seam loops is at a different location from the fasten-off row of the yarns forming the edge of the seam area. In addition, when one fasten-off row is provided on the borderline between the seam area and the basic fabric, an advantage is achieved that the seam area is quick to weave on the seaming machine. Namely, at the machine direction yarn fastened off on the borderline of the basic fabric there is no need to weave a backside machine direction yarn on the seaming machine in the seam area, and consequently the number of work cycles of the seaming machine is fewer and thus the work is faster to perform.

The basic idea of an embodiment is that the first fasten-off row is substantially on the borderline of the seam area and the basic fabric. Thus, at the yarns forming the edges of the seam area the backside machine direction yarns are woven on the seaming machine on the seam area up to the second fasten-off row.

The basic idea of an embodiment is that the dryer fabric comprises at least two superposed fabric layers, namely a top fabric and a bottom fabric. The top fabric is on the paper side and the bottom fabric is on the backside. Between the top fabric and the bottom fabric there may be one or more intermediate fabrics. Each fabric layer may be an independent fabric layer that comprises specific longitudinal yarns and specific transverse yarns. The fabric layers may be woven simultaneously on the weaving machine and interconnected with a plurality of yarns.

The basic idea of an embodiment is that the longitudinal yarns of the top fabric are fastened off with substantially the same weave pattern as the longitudinal yarns of the bottom fabric in the basic structure of the dryer fabric.

The basic idea of an embodiment is that the longitudinal yarns of the top fabric are fastened off with a different weave pattern from the longitudinal yarns of the bottom fabric in the basic structure of the dryer fabric.

The basic idea of an embodiment is that, seen in the cross machine direction, every second machine direction yarn of the top fabric is arranged to form above-mentioned seam loops and every other machine direction yarn of the top fabric is arranged to form the outermost edge of the seam area.

The basic idea of an embodiment is that the dryer fabric comprises cross machine direction bottom yarns, i.e. bottom wefts, at least in the basic structure of the dryer fabric. The dryer fabric may also comprise bottom wefts in the seam area.

The basic idea of an embodiment is that the seam area has a single-layer structure.

The basic idea of an embodiment is that between the top fabric and the bottom fabric there are a plurality of cross machine direction filling yarns and that the filling yarns are arranged in the dryer fabric without interlacing with the yarns of the top fabric and the bottom fabric. The filling yarns may provide additional tenseness to the structure of the dryer fabric. Further, the filling yarns may add to the cross machine direction rigidity of the dryer fabric and may thus render the fabric more stable.

The basic idea of an embodiment is that the top fabric and the bottom fabric comprise a 4-shaft weave.

The basic idea of an embodiment is that the machine direction yarns of the top fabric and the bottom fabric are flat in cross section, for instance, oval or rectangular yarns. As it is known, the flat yarns are rigid in one direction and very flexible in another direction. Hence, the fabric layer woven of flat yarns is very sturdy in fabric plane. The flat yarns support the structure of the fabric in the surface direction thereof. Moreover, when flat yarns are used, the bottom surface may be smoother than in the case of round yarns, and consequently the fabric carries along less air. Thus, the fabric has good aerodynamic properties and good runnability on the paper machine. In addition, the surface facing the web to be dried may be smoother when flat yarns are used than when round yarns are used.

The basic idea of an embodiment is that the dryer fabric has a single-layer basic structure, in which there are at least two superposed layers of machine direction yarns and one layer of cross machine direction yarns.

BRIEF DESCRIPTION OF THE DRAWINGS

Some embodiments of the invention will be described in greater detail in connection with the attached drawings, in which.

The figures show some embodiments of the invention in a simplified manner for the sake of clarity. Like reference numerals refer to like parts in the figures.

DETAILED DESCRIPTION OF SOME EMBODIMENTS OF THE INVENTION

Figure 1:
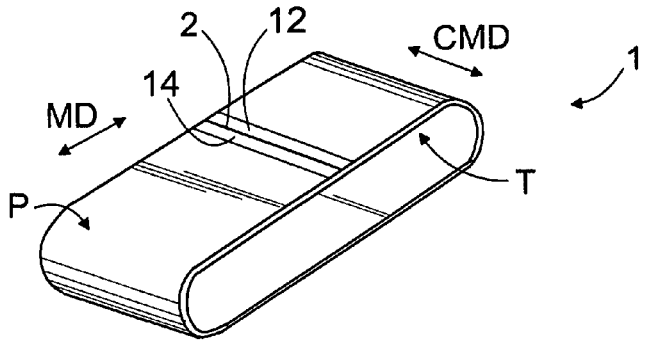
FIG. 1 is a schematic, perspective view of a dryer fabric that can be run as a closed loop in a dryer section of a paper machine.

FIG. 1 shows a greatly simplified view of a dryer fabric 1 that can be run in machine direction MD and that has a width in cross machine direction CMD. The dryer fabric 1 may comprise one or more seams 2 woven separately on the seaming machine, whereby the fabric may be connected to a closed loop in the drying section of a paper machine. The seam makes the mounting of the dryer fabric 1 easier and faster.

Figure 2:
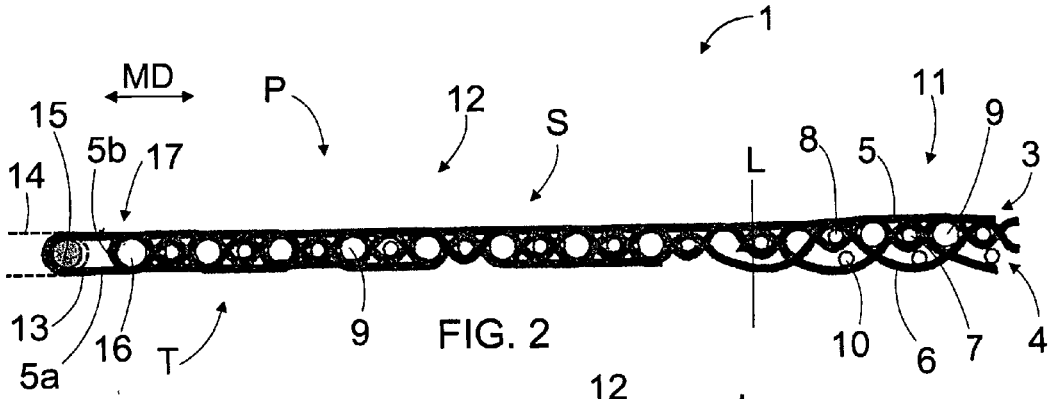
FIG. 2 is a schematic view in cross machine direction CMD of a connecting end of a dryer fabric in accordance with the invention.

FIG. 2 shows a dryer fabric 1 of the invention seen in cross machine direction CMD. The dryer fabric 1 has a paper side surface P, against which the paper web to be dried may be arranged in the dryer section. Further, on the opposite side of the dryer fabric there is a bottom surface T, which may be supported against the rolls of the paper machine. The dryer fabric 1 may comprise at least two superposed fabrics, namely a top fabric 3 on the paper side and a bottom fabric 4 on the backside T. The top fabric 3 and the bottom fabric 4 are formed on the weaving machine and they may comprise specific yarn systems each, i.e. machine direction MD yarns 5, 6 and cross machine direction CMD yarns 7,8. The top fabric 3 and the bottom fabric 4 may be woven on the same weaving machine simultaneously. The top fabric 3 and the bottom fabric 4 may be interconnected such that a plurality of machine direction yarns 5 of the top fabric 3 run through the cross machine direction yarns 8 of the bottom fabric 4, and correspondingly, the machine direction yarns 6 of the bottom fabric 4 run through the cross machine direction yarns 7 of the top fabric 3. All machine direction yarns, or just some of them, may be involved in binding. The dryer fabric 1 may be woven such that the yarns 5,6 running in machine direction MD are warp yarns and the yarns 7, 8 running in cross machine direction CMD are weft yarns. Between the fabric layers 3, 4 there may be a plurality of filling yarns 9 in cross machine direction that make the structure of the dryer fabric 1 more dense. The filling yarns 9 may be arranged during weaving such that they do not interlace at all with the yarns in the top fabric 3 and the bottom fabric 4. Further, the bottom fabric 4 may comprise bottom yarns 10 in cross machine direction, which bind with the machine direction yarns 6 of the bottom fabric 4. The top fabric 3 and the bottom fabric 4 may have a 4-shaft weave structure.

FIG. 2 shows, in addition to the basic structure 11 of the fabric, also a connecting end 12 of the fabric, which comprises seam loops 13, and a a seam area S. The borderline between the basic structure 11 and the seam area S is indicated by a cross machine direction line L. The seam area S must have a given length in machine direction MD, in order that the seam loops 13 will have a sufficient strength and that the yarns 5 to be fastened off will be connected firmly to the seam area S. Thus, the yarns in the seam area S have to be treated after the actual fabric weaving on a seaming machine, but the seaming machine does not provide any changes in the structure of the basic fabric 11. FIG. 2 further shows, in a broken line, a second connecting end 14 of the fabric that also comprises seam loops. The seam loops 13 at the connecting ends 12, 14 may be arranged to interleave on the paper machine and a seam yarn 15 or the like, interconnecting the connecting ends, may be arranged in the obtained seam loop passage. As it appears from the figure, the seam area S may have a different structure from the basic structure 11 of the fabric. Outermost in the seam area S there is a cross machine direction edge yarn 16, through which some of the machine direction yarns 5*b* of the top fabric 3 are arranged to run, whereby an edge 17 is produced in the outermost portion of the seam area S.

Figure 3:
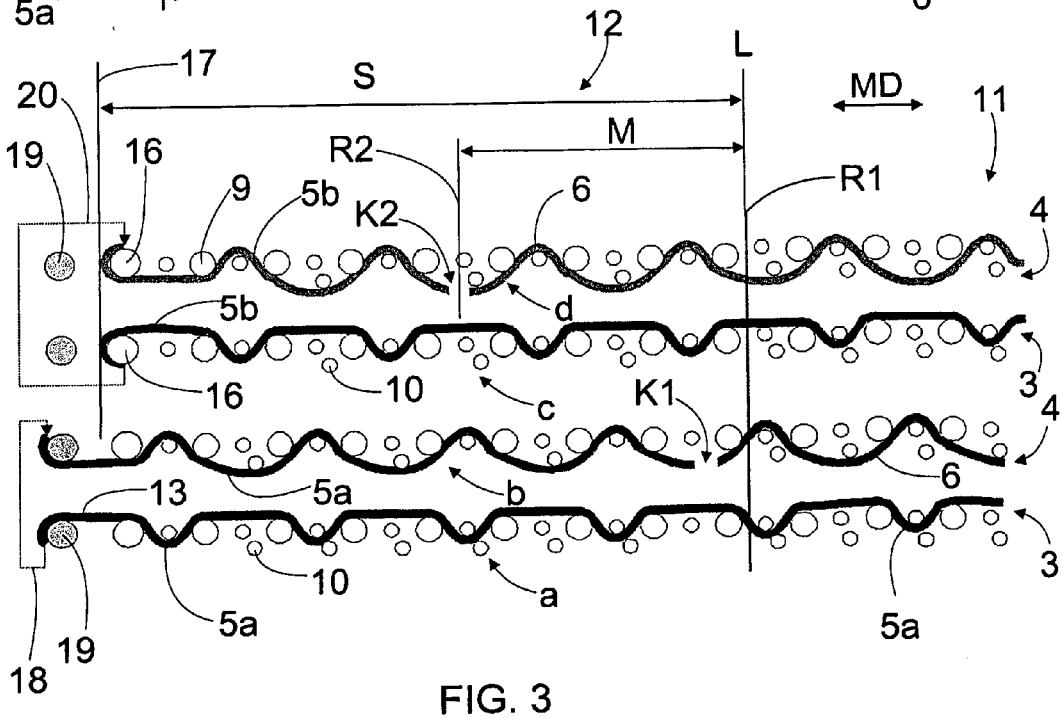
FIG. 3 shows schematically how a seam structure is formed and fastened off in the dryer fabric of FIG. 2, seen in cross machine direction CMD.

FIG. 3 and figure parts a to d thereof illustrate how a connecting end 12 of the dryer fabric is formed on the seaming machine. The two lowest figure parts a and b depict a weave pattern of machine direction yarns 5*a* forming seam loops 13 and the two topmost figure parts c and d depict a weave pattern of machine direction yarns 5*b* forming the edge 17 of the seam area S. For easy understanding, a broken line 18 in figure parts a and b indicate how the yarn 5*a* of the top fabric 3 turns about an auxiliary yarn 19 as the seam is woven and returns forming a seam loop 13. Further, a broken line 20 in figure parts c and d indicate how the yarn 5*b* of the top fabric 3 turns about the outermost yarn, i.e. the edge yarn 16 of the seam area S as the seam is woven and returns thus forming the edge 17 of the seam area S. The yarns 5*a*, 5*b* are fastened off such that they are woven on the side of the backing of the seam area S and then cut at fasten-off points K1 and K2. Seen in the cross machine direction of the fabric, the fabric may be woven such that every second machine direction yarn forms seam loops 13 and every other may participate in forming the edge 17. Naturally, other weave structures may also be used, for instance, such that two adjacent yarns form seam loops and two adjacent yarns participate in forming the edge.

In cross machine direction CMD, a plurality of aligned fasten-off points K1 and correspondingly K2 form in the fabric a first fasten-off row R1 and a second fasten-off row R2, respectively. The yarns 5*a* forming seam loops are fastened off at line L, where the first fasten-off row R1 is thus formed. In that case the machine direction yarn 6 of the bottom fabric 4 at the yarn 5*a* need not be treated on the seaming machine. The yarns 5*b* forming the edge 17 are fastened off at a machine direction MD distance M from the first fasten-off row R1, whereby a second fasten-off row R2 is formed at this location. At the yarn 5*b* forming the edge 17 the machine direction yarn 6 of the bottom fabric 4 is woven up to the second fasten-off row R2 for a distance M. The weave pattern of the yarn 6 in the portion M may be the same as in the basic portion 11 of the fabric. Further, the weave patterns of the yarn 5*a* returning about the auxiliary yarn 19 and the yarn 5*b* returning about the edge yarn 16 may correspond to the weave pattern of the machine direction yarn 6 of the bottom fabric 4. On the other hand, in some cases their weave patterns may differ from the weave pattern of the yarn 6, and the weave patterns of the yarns 5*a*, 5*b* need not always be mutually the same.

Figures 4, 5:
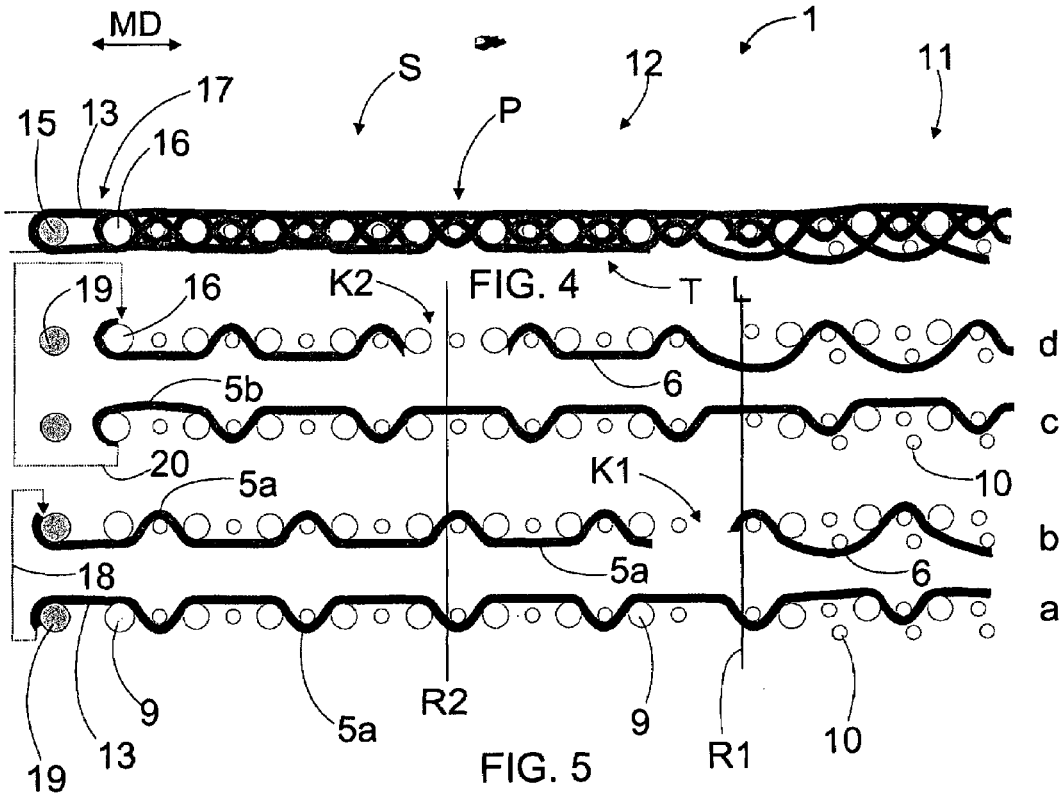
FIG. 4 shows schematically a connecting end of another dryer fabric of the invention, seen in cross machine direction CMD.
FIG. 5 shows schematically how a seam structure in the dryer fabric of FIG. 4 is formed and fastened off, seen in cross machine direction.

FIGS. 4 and 5 show an alternative dryer fabric 1 and a connecting end 12 thereof. The fabric differs from the solution shown in FIGS. 2 and 3 in that the seam area S does not comprise cross machine direction bottom yarns 10. The seam area S has a single-layer structure. Line L is clearly distinguishable from the structure as a point, from which onwards in the direction of the seam area S no bottom yarns 10 will appear. A further difference from the solution shown in previous FIGS. 2 and 3 is that the yarns 5*a* and 5*b* are fastened off in the seam area S using a weave pattern different from that of the machine direction yarn 6 of the bottom fabric 4. Otherwise the details shown in the previous figures also apply to the dryer fabric of FIGS. 4 and 5.

If so desired, instead of one single second fasten-off row R2 shown in FIGS. 2 to 5, yarns 5*b* forming the edge 17 may also be fastened off in plurality of fasten-off rows, for instance, two, three or four fasten-off rows. However, the yarns 5*a* forming seam loops 13 are always fastened off in the vicinity of line L, so that the number of seaming work cycles may be reduced.

In a further alternative embodiment the yarns 5*a* forming seam loops are fastened off in the second fasten-off row R2 and the yarns 5*b* forming the edge 17 are fastened off in the first fasten-off row R1. In that case the machine direction yarn 6 of the bottom fabric 4 locating at the yarn 5*b* need not be treated on the seaming machine.

The seam area S of the invention may also be applied to a dryer fabric 1 having a single-layer structure.

The dryer fabric allows application of various polymeric yarn materials, yarn structures and cross sections. The machine direction yarns of the dryer fabric may be flat in cross section, for instance, oval or rectangular yarns. The top fabric and the bottom fabric may have a single-layer structure, which comprises cross machine direction yarns in one layer, or in some cases they may have a two-layer structure. The weave of the fabric may be a four-shaft structure, but it may also be some other structure, for instance, a six- or eight-shaft structure. Further, it is possible that the fabric comprises no cross machine direction bottom yarns 10 shown in the figures. In addition, the dryer fabric does not necessarily comprise cross machine direction filling yarns 9, but the stability and tenseness of the fabric may be achieved by other means.

In some cases features disclosed in the present application may be used as such, irrespective of other features. On the other hand, features disclosed in this application may be combined, if so desired, to provide various combinations.

The drawings and the relating description are only intended to illustrate the inventive idea. The details of the invention may vary within the scope of the claims.

The invention claimed is:

1. A dryer fabric, which has a bottom surface and a surface facing a paper web to be dried and which is woven of a plurality of machine direction longitudinal yarns and a plurality of cross machine direction transverse yarns, and in which dryer fabric there are at least two superposed machine direction yarn systems, namely, the paper side machine direction yarns and the backside machine direction yarns, and in which dryer fabric there is at least one first cross machine direction connecting end and at least one second cross machine direction connecting end, each of the connecting ends comprising a seam area and on the outermost edge of the connecting end a plurality of seam loops for interconnecting the connecting ends of the dryer fabric and for providing a dryer fabric in the form of a closed loop, and which seam area has a predetermined length in machine direction extending from the seam loops to a cross machine direction line where the basic structure of the dryer fabric begins, and in which a plurality of paper side first machine direction yarns are arranged to form said seam loops and in which a plurality of paper side second machine direction yarns are arranged to form the outermost edge of the seam area, and in which the paper side machine direction yarns are cut and fastened off by weaving in the seam area on the backside of the dryer fabric such that in the seam area there is at least one cross machine direction fasten-off row, and further, in which the machine direction yarns of the backside extend to said fasten-off row, and wherein the seam area comprises at least two cross machine direction fasten-off rows at a machine direction distance from one another, machine direction yarns that form seam loops have been fastened off in a first fasten-off row and machine direction yarns that form an edge of the seam area have been fastened off in at least one second fasten-off row, and one fasten-off row is substantially at the beginning line of the seam area.

2. The dryer fabric of claim 1, wherein the first fasten-off row is substantially at the beginning line of the seam area.

3. The dryer fabric of claim 1, wherein the dryer fabric comprises at least a top fabric and a bottom fabric in superposition, in which the top fabric is on the paper web side and the bottom fabric is on the backside;

the top fabric and the bottom fabric are independent fabric layers that comprise specific machine direction yarns and specific cross machine direction yarns and the top fabric and the bottom fabric have been woven simultaneously on one weaving machine and interconnected with a plurality of yarns.

4. The dryer fabric of claim 1, wherein the dryer fabric comprises at least a top fabric and a bottom fabric in superposition, in which the top fabric is on the paper web side and the bottom fabric is on the backside;

the top fabric and the bottom fabric are independent fabric layers that comprise specific machine direction yarns and specific cross machine direction yarns, the top fabric and the bottom fabric have been woven simultaneously on one weaving machine and interconnected with a plurality of yarns and the machine direction yarns of the top fabric are fastened off using substantially the same weave structure as that of the machine direction yarns of the bottom fabric in the basic structure of the dryer fabric.

5. The dryer fabric of claim 1, wherein the dryer fabric comprises at least a top fabric and a bottom fabric in superposition, in which the top fabric is on the paper web side and the bottom fabric is on the backside;

the top fabric and the bottom fabric are independent fabric layers that comprise specific machine direction yarns and specific cross machine direction yarns, the top fabric and the bottom fabric have been woven simultaneously on one weaving machine and interconnected with a plurality of yarns, and the machine direction yarns of the top fabric are fastened off using a weave structure different from that of the machine direction yarns of the bottom fabric in the basic structure of the dryer fabric.

6. The dryer fabric of claim 1, wherein the dryer fabric has a single-fabric basic structure.

7. The dryer fabric of claim 1, wherein seen in cross machine direction, every second machine direction yarn of the top fabric is arranged to form seam loops and every other machine direction yarn of the top fabric is arranged to participate in forming the outermost edge of the seam area.

8. The dryer fabric of claim 1, wherein the dryer fabric comprises cross machine direction bottom yarns on the backside at least in the basic structure of the dryer fabric.

9. The dryer fabric of claim 1, wherein the dryer fabric comprises cross machine direction bottom yarns on the backside in the basic structure and the seam area of the dryer fabric.

10. The dryer fabric of claim 1, wherein the seam area has a single-layer structure.

11. The dryer fabric of claim 1, wherein the dryer fabric comprises at least a top fabric and a bottom fabric in superposition, in which the top fabric is on the paper web side and the bottom fabric is on the backside;

the top fabric and the bottom fabric are independent fabric layers that comprise specific machine direction yarns and specific cross machine direction yarns, the top fabric and the bottom fabric have been woven simultaneously on one weaving machine and interconnected with a plurality of yarns, between the top fabric and the bottom fabric there are a plurality of cross machine direction filling yarns, and the filling yarns are arranged in the dryer fabric without binding with the yarns of the top fabric and the bottom fabric.

12. The dryer fabric of claim 1, wherein the dryer fabric comprises at least a top fabric and a bottom fabric in superposition, in which the top fabric is on the paper web side and the bottom fabric is on the backside;

the top fabric and the bottom fabric are independent fabric layers that comprise specific machine direction yarns and specific cross machine direction yarns, the top fabric and the bottom fabric have been woven simultaneously on one weaving machine and interconnected with a plurality of yarns, and the top fabric and the bottom fabric comprise a four-shaft weave structure.

13. A seam area of a dryer fabric locating at a connecting end of the dryer fabric, the dryer fabric comprising: a bottom surface and a surface facing a paper web to be dried; a plurality of cross machine direction transverse yarns and a plurality of machine direction longitudinal yarns arranged to form at least two superposed machine direction yarn systems, namely a paper web side machine direction yarn system and a backside machine direction yarn system, the outermost first edge of the seam area comprising a plurality of seam loops, the seam area having a predetermined length in machine direction extending from the first edge to the second edge on the side of the basic structure of the dryer fabric, and in which seam area a plurality of paper web side machine direction first yarns are arranged to form said seam loops and in which a plurality of the paper web side machine direction second yarns are arranged to form the outermost edge of the seam area, and in which the paper web side machine direction yarns are cut and fastened off by weaving in the seam area on the backside of the dryer fabric such that in the seam area there is at least one cross machine direction fasten-off row and in which the machine direction yarns of the backside extend to said fasten-off row, and the seam area comprises at least two cross machine direction fasten-off rows at a machine direction distance from one another, machine direction yarns that form seam loops have been fastened off in a first fasten-off row and machine direction yarns that form an edge of the seam area have been fastened off in at least one second fasten-off row, and one fasten-off row is substantially at the second edge of the seam area.

14. The seam area of claim 13, wherein the seam area has a single-layer structure.

* * * * *